US009643761B1

(12) United States Patent
Guirguis et al.

(10) Patent No.: US 9,643,761 B1
(45) Date of Patent: May 9, 2017

(54) CHILD-RESISTANT CONTAINERS

(71) Applicant: Inline Plastics Corp., Shelton, CT (US)

(72) Inventors: Sameh Guirguis, Monroe, CT (US); Victor Ivenitsky, South Salem, NY (US)

(73) Assignee: Inline Plastics Corp., Shelton, CT (US)

( * ) Notice: Subject to any disclaimer, the term of this patent is extended or adjusted under 35 U.S.C. 154(b) by 0 days.

(21) Appl. No.: 14/962,927

(22) Filed: Dec. 8, 2015

(51) Int. Cl.
*B65D 43/02* (2006.01)
*B65D 55/02* (2006.01)
*B65D 43/16* (2006.01)
*B65D 50/00* (2006.01)

(52) U.S. Cl.
CPC ..... *B65D 55/024* (2013.01); *B65D 43/16* (2013.01); *B65D 50/00* (2013.01); *B65D 43/0235* (2013.01); *B65D 43/162* (2013.01); *B65D 2101/0023* (2013.01); *B65D 2543/00833* (2013.01)

(58) Field of Classification Search
USPC ..... 220/805, 266, 4.21, 270
See application file for complete search history.

(56) References Cited

U.S. PATENT DOCUMENTS 646,563 A 4/1900 Bontrager et al.
2,438,499 A 3/1948 Hartman
2,537,786 A 1/1951 Jules
3,164,478 A * 1/1965 Bostrom ..... B65D 85/36 206/303
3,511,433 A * 5/1970 Andrews ..... B65D 43/162 220/4.23
3,669,606 A * 6/1972 Brown ..... B29C 51/34 425/346
3,756,115 A 9/1973 Schuplin
4,555,043 A * 11/1985 Bernhardt ..... B65D 43/0218 220/257.1
4,576,330 A * 3/1986 Schepp ..... B65D 43/162 220/315
4,742,935 A * 5/1988 Schellenberg ..... B65D 43/021 220/270
4,771,934 A * 9/1988 Kalmanides ..... B65D 43/162 206/470
4,886,204 A * 12/1989 Kalmanides ..... B65D 43/162 206/470
5,507,406 A * 4/1996 Urciuoli ..... B65D 43/021 215/209

(Continued)

OTHER PUBLICATIONS

U.S. Appl. No. 14/869,868, filed Sep. 29, 2015.

(Continued)

*Primary Examiner* — J. Gregory Pickett
*Assistant Examiner* — Gideon Weinerth
(74) *Attorney, Agent, or Firm* — Locke Lord LLP; Barry Kramer; Alicia J. Carroll

(57) ABSTRACT

A child-resistant container includes a lid and a base. The lid includes a peripheral flange that defines a lifting tab. The base includes an upper peripheral rim. A skirt extends downwardly from the upper peripheral rim to a lower edge thereof. A bend line extends between two adjacent sides of the base to define a corner portion of the base that accommodates the lifting tab when the container is closed forming a child-resistant opening mechanism. The bend line facilitates bending of the corner portion of the base to gain access to the lifting tab.

17 Claims, 10 Drawing Sheets

(56) References Cited

U.S. PATENT DOCUMENTS 5,584,408 A 12/1996 Orkisz
5,685,444 A 11/1997 Valley
6,305,546 B1 10/2001 Saunders et al.
6,625,955 B2 * 9/2003 Aylward ..... B65B 11/50 53/133.4
7,073,680 B2 7/2006 Boback et al.
7,118,003 B2 10/2006 Sellari et al.
D602,774 S 10/2009 Parikh et al.
8,240,505 B1 * 8/2012 Chen ..... B65D 43/162 220/4.21
8,261,933 B2 * 9/2012 Kidd ..... B65D 75/22 220/324
8,272,526 B1 9/2012 Vovan et al.
8,608,008 B2 12/2013 Gingras et al.
8,640,914 B2 2/2014 Meyer et al.
8,684,212 B2 4/2014 Stone et al.
8,795,580 B2 8/2014 Sellari et al.
8,925,755 B2 * 1/2015 Lesquir ..... B65D 43/0249 220/266
9,187,209 B1 11/2015 Hanna et al.
9,242,769 B2 * 1/2016 Gartz ..... B65D 43/0206
9,278,786 B2 * 3/2016 Vovan ..... B65D 43/0254
2003/0051350 A1 3/2003 Harrold
2003/0192888 A1 10/2003 Chang
2005/0247709 A1 11/2005 Atkins et al.
2006/0289541 A1 12/2006 Boback et al.
2007/0045317 A1 * 3/2007 Rosender ..... B65D 43/0249 220/266
2007/0138180 A1 6/2007 Vovan
2009/0120937 A1 * 5/2009 Vovan ..... B65D 43/0206 220/266
2009/0134180 A1 * 5/2009 Kidd ..... B65D 43/162 220/836
2009/0206082 A1 * 8/2009 Vovan ..... B65D 43/0249 220/266
2010/0072217 A1 * 3/2010 Parikh ..... B65D 55/024 220/833
2010/0276422 A1 * 11/2010 Vovan ..... B65D 43/021 220/260
2011/0000929 A1 * 1/2011 Brown ..... B65D 43/162 220/810
2012/0005994 A1 * 1/2012 Tidball ..... B65D 21/0233 53/484
2012/0103990 A1 * 5/2012 McCumber ..... B65D 41/165 220/270
2013/0020325 A1 * 1/2013 Stone ..... B65D 43/0268 220/270
2013/0160406 A1 * 6/2013 Johnston ..... B65B 7/26 53/467
2013/0320015 A1 12/2013 Dyble et al.
2014/0041343 A1 * 2/2014 Corbett ..... B65D 43/162 53/492
2014/0069922 A1 3/2014 Boback et al.
2014/0138383 A1 * 5/2014 Lisowy ..... B65D 43/162 220/270
2014/0300034 A1 10/2014 Sellari et al.
2014/0367383 A1 12/2014 Sellari et al.
2015/0028033 A1 * 1/2015 Samuel ..... B65D 43/0266 220/270
2015/0060454 A1 3/2015 Kowal et al.
2015/0060455 A1 * 3/2015 Chou ..... B65D 17/24 220/270
2015/0083725 A1 * 3/2015 Sinha ..... B65D 43/0272 220/265
2015/0225139 A1 * 8/2015 Baker ..... B65D 25/04 206/45.24
2015/0266611 A1 * 9/2015 Dow ..... B65D 43/162 220/269
2015/0298853 A1 * 10/2015 Chen ..... B65D 43/0254 220/270
2015/0307239 A1 10/2015 Chen
2015/0329249 A1 * 11/2015 Gingras ..... B65D 43/0235 220/270
2015/0367987 A1 * 12/2015 Clark ..... B65D 21/0201 220/23.86
2016/0023815 A1 * 1/2016 Siskindovich ..... B65D 43/0254 220/270

OTHER PUBLICATIONS

PCT International Search Report and Written Opinion dated Mar. 14, 2017, issued during the prosecution of PCT International Patent Application No. PCT/US2016/064283 (12 pages).
Non-Final Office Action dated Dec. 30, 2016 issued in U.S. Appl. No. 15/215,496.
Non-Final Office Action dated Dec. 30, 2016 issued in U.S. Appl. No. 15/215,505.
PCT International Search Report and Written Opinion dated Mar. 17, 2017, issued during the prosecution of PCT International Patent Application No. PCT/US2016/064281 (17 pages).

* cited by examiner

Fig. 9
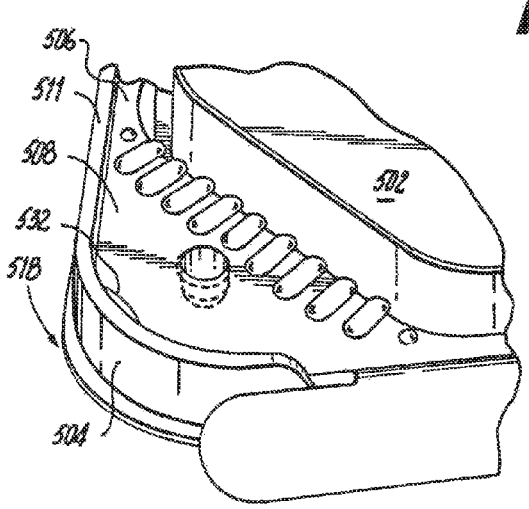
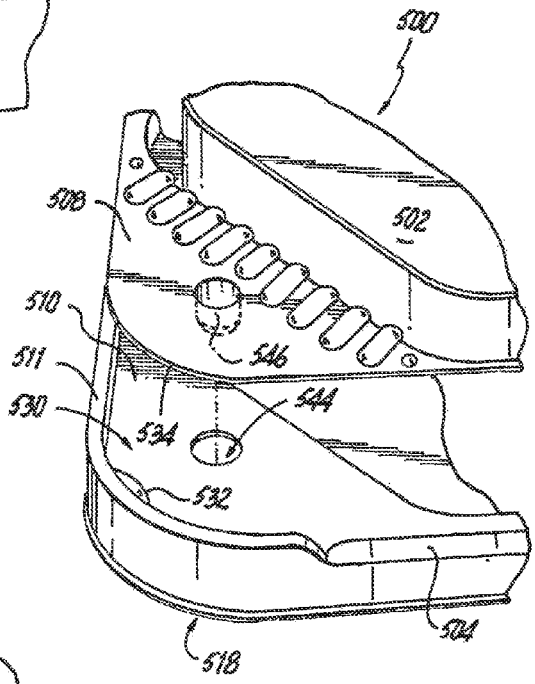
Fig. 10
Fig. 11
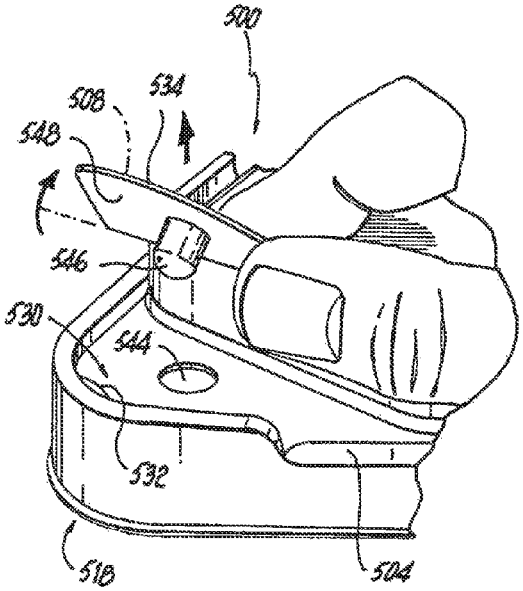

CHILD-RESISTANT CONTAINERS

BACKGROUND OF THE INVENTION

1. Field of the Invention

The subject invention is directed to containers and packaging, and more particularly, to containers and packaging that incorporate child-resistant features.

2. Background of the Related Art

Disposable containers for packaging, distributing, displaying or otherwise housing consumer items, some of which are not safe for use by children, are becoming increasingly important. The advent of plastics resulted in many products being wrapped or packaged in plastic, both in the form of flexible plastic bags and rigid plastic containers. The use of plastics in the modern-day convenience food industry has significantly improved the "shelf life" of perishable products, allowing both merchants and their customers to store the products for longer periods of time, resulting in substantial savings.

It has been found that consumers like recloseable packages, particularly for comestible products, especially in circumstances where more than one serving of a comestible product is contained therein, in order to reduce drying out or other deterioration of the comestible food product. In addition, consumers prefer to visually inspect the product within such containers prior to purchase. Thus, fabricating containers from clear see-through plastics is desirable. In addition to the aforementioned consumer design preferences, it is desirable to fabricate containers that include features which either deter unauthorized tampering or clearly indicate whether unauthorized tampering has occurred, or both.

Thus, there is a need for containers having design elements, such as recloseability features which are reliable and easy to operate, along with child-resistant features that deter children from gaining access to the contents of the container. Accordingly, the present invention is directed to a container that meets these needs.

SUMMARY OF THE DISCLOSURE

The present disclosure is directed to a child-resistant container which includes a lid and a base. The lid includes peripheral flange that defines a lifting tab. The base includes an upper peripheral rim. A skirt extends downwardly from the upper peripheral rim to a lower edge thereof. A bend line extends between two adjacent sides of the base to define a corner portion of the base that accommodates the lifting tab when the container is closed forming a child-resistant opening mechanism.

It is contemplated that the base can include opposed indented portions in the skirt. In some embodiments of the present disclosure, a pair of relief sections is defined in the lower edge of the skirt. Each relief section can be adjacent to one of the opposed indented portions. Each relief section can correspond to a respective end of the bend line. It is contemplated that each relief section can be defined on a respective side of the two adjacent sides of the base. Each relief section can be a notch extending upwardly toward the bend line. In accordance with certain embodiments, each of the opposed indented portions can be adjacent to a respective end of the bend line. It is contemplated that the lifting tab can include ribs extending upwardly from a top surface of the lifting tab.

In embodiments of the present disclosure, the upper peripheral rim includes a plateau on the corner portion of the base. The base can include a recess defined in the corner portion of the base adjacent to the plateau to receive the lifting tab when the container is closed. The base can include a retaining projection extending into the recess overlapping an outer edge of the lifting tab when the container is closed. It is contemplated that the retaining projection can include a beveled surface facing in a direction toward or away from the recess.

In accordance with certain embodiments, the lid can include a protrusion extending from a bottom surface of the lifting tab. The protrusion can extend into an aperture formed in the corner portion of the base when the container is closed.

Embodiments of the disclosed container can include a tamper-evident hinge joining the lid with the base, the hinge including a frangible section. The frangible section can include at least one line of weakness, for example, a single score line, or the frangible section can include two parallel score lines defining a tear strip therebetween. The corner portion of the base and the tamper-evident hinge can be on the same lateral side of the base. It is also contemplated that the base can include a bead extending upwardly from the upper peripheral rim and which extends substantially about the perimeter of the container.

The present disclosure is further directed to a child-resistant container comprising a lid and a base. The lid has peripheral flange which defines a lifting tab having top and bottom surfaces and includes a protrusion extending downwardly from the bottom surface of the lifting tab. The base includes an upper peripheral rim and an aperture formed in a corner portion of the base to receive the protrusion of the lid when the container is closed forming a child-resistant opening mechanism. The base includes a recess defined in the corner portion of the base to receive the lifting tab when the container is closed.

In some embodiments, the base includes a retaining projection extending into the recess overlapping an outer edge of the lifting tab when the container is closed. The retaining projection can include a beveled surface facing in at least one of a direction toward the recess or a direction away from the recess. Embodiments of the disclosed container include a tamper-evident hinge joining the lid with the base. The hinge can have a frangible section. The frangible section can include at least one line of weakness, for example, a single score line, or the frangible section can include two parallel score lines defining a tear strip therebetween. The corner portion of the base and the tamper-evident hinge can be on the same lateral side of the base. It is also contemplated that the base can include a bead extending upwardly from the upper peripheral rim and which extends substantially about the perimeter of the container.

These and other unique features of embodiments of the present invention will become more readily apparent from the following description and the accompanying drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 9 is a perspective view of a portion of another embodiment of a child-resistant, tamper-resistant and tamper-evident container constructed in accordance with the present invention, showing a lifting tab within a recess of the corner portion of the base in the closed position;

FIG. 10 is a perspective exploded view of a portion of the container shown in FIG. 9, showing a protrusion extending from a bottom surface of a lifting tab;

FIG. 11 is a perspective view of a portion of the container shown in FIG. 9, showing the container being opened with lifting tab raised from the recess of the corner portion.

DETAILED DESCRIPTION OF THE PREFERRED EMBODIMENTS

Figure 1:
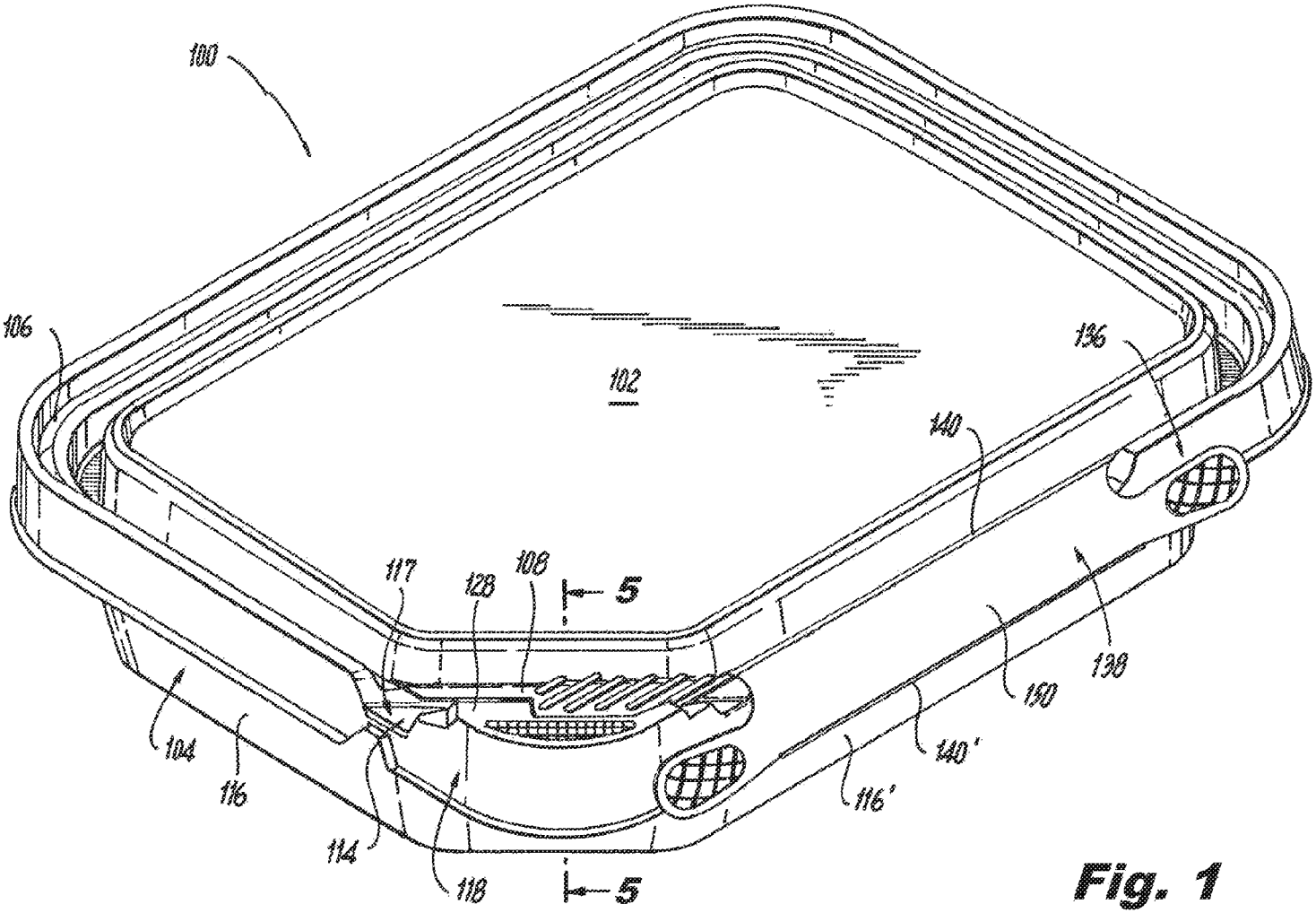
FIG. 1 is a perspective view of a child-resistant, tamper-resistant and tamper-evident container constructed in accordance with the present invention having a lid and a base, and showing a corner portion of the base accommodating a lifting tab of the lid when the container is closed forming a child-resistant opening mechanism.

Reference will now be made to the drawings wherein like reference numerals identify similar structural features or aspects of the subject disclosure. For purposes of explanation and illustration, and not limitation, a partial view of an exemplary embodiment of a child-resistant container 100 in accordance with the disclosure is shown in FIG. 1 and is designated generally by reference character 100. Other embodiments of child-resistant containers in accordance with the disclosure, or aspects thereof, are provided in FIGS. 2-10, as will be described.

As shown in FIG. 1, a recloseable child-resistant container 100 includes a lid 102 and a base 104. Lid 102 includes a peripheral flange 106 that defines a lifting tab 108. It is contemplated that peripheral flange 106 can be outwardly extending and/or upwardly extending from lid 102. In the embodiment shown flange 106 extends upwardly and outwardly from lid 102. A bend line 117 extends between two adjacent sides 116 and 116' of base 104 to define a corner portion 118 of base 104. Bend line 117 facilitates the bending of corner portion 118 of base 104 to gain access to lifting tab 108. Bend line 117 is defined by a groove 114 extending between sides 116 and 116'. In addition to or instead of groove 114, it is contemplated that bend line 117 can be defined by a line or section of material thinner than the material on other portions of container 100, material cuts or perforations, or any other suitable weakening feature that facilitates bending between corner portion 118 and the remainder of base 104. In the closed position, lifting tab 108 is nested within corner portion 118 of base 104.

With continued reference to FIG. 1, base 104 includes a plateau 128 on corner portion 118 of base 104. In the closed position, lifting tab 108 is rendered relatively inaccessible by plateau 128, forming a child-resistant opening mechanism. Those skilled in the art will readily appreciate that child-resistance can be gauged by testing container 100 in accordance with International Organization for Standardization (ISO) Standard ISO 8317:2013(E).

Figure 2:
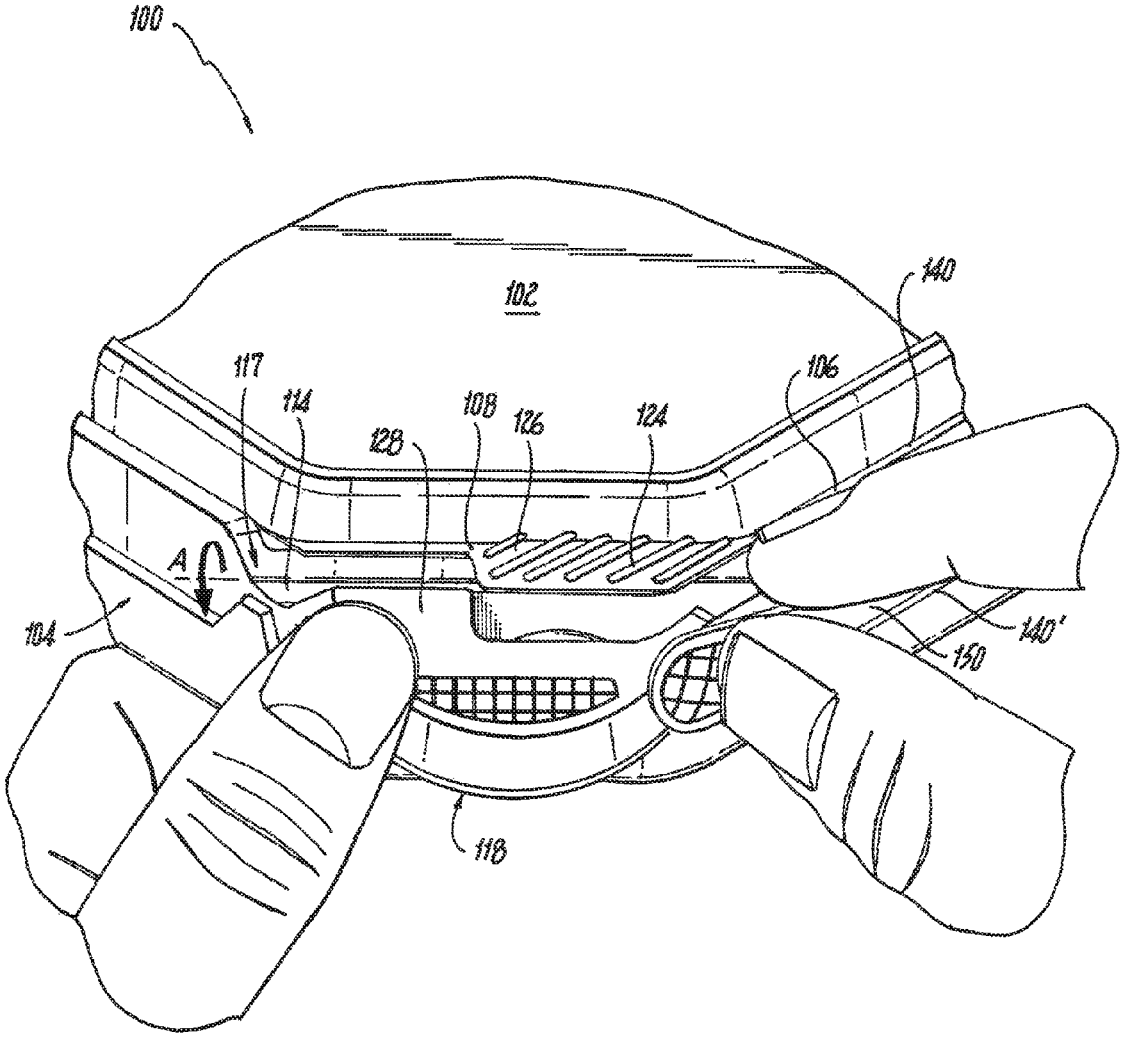
FIG. 2 is a perspective view of a portion of the container of FIG. 1, showing the corner portion of the base being bent downward to gain access to the lifting tab of the lid.

With reference now to FIG. 2, container 100 is accessed by bending corner portion 118 downward, as oriented in FIG. 2, about bend line 117, e.g. away from lifting tab 108. In accordance with this embodiment, bend line 117 is substantially aligned with a longitudinal axis A defined by groove 114. By bending corner portion 118 downward, plateau 128 is moved lower than lifting tab 108 and access to lifting tab 108 is provided. Lifting tab 108 includes ribs 124 extending upwardly from a top surface 126 of lifting tab 108 to assist in gripping lifting tab 108. A consumer can then raise lifting tab 108, thereby applying force to remove lid 102 from base 104 and open container 100. Bend line 117 is resilient so that, if needed, corner portion 118 can be bent about bend line 117 multiple times.

Figure 3:
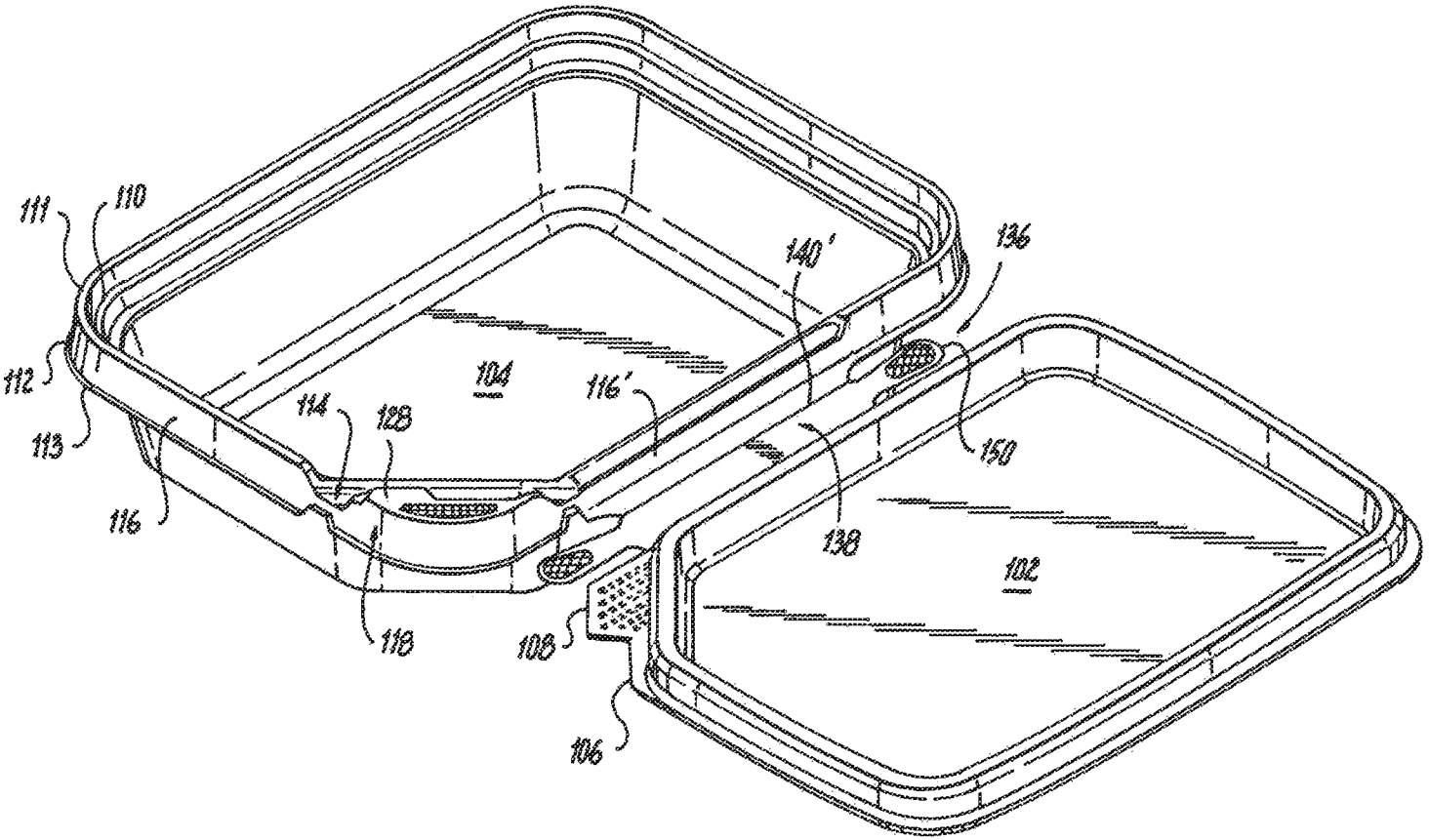
FIG. 3 is a perspective view of the container of in FIG. 1, showing the container in an open position.

As shown in FIGS. 1 and 3, container 100 includes a tamper-evident hinge 136 joining lid 102 with base 104. Hinge 136 includes a frangible section 138. Frangible section 138, in the embodiment shown, includes two lines of weakness 140 and 140', e.g. parallel score lines, perforation lines, and/or other suitable weakened or stressed lines, which define a tear strip 150. Those skilled in the art will readily appreciate that while container 100 is shown with two lines of weakness 140 and 140', any suitable number of lines of weakness can be used. For example, one line of weakness can be used. In the case where one line of weakness is used, the frangible section can be severed by depressing the one line of weakness. In the embodiment shown, corner portion 118 of base 104 and tamper-evident hinge 136 are on the same lateral side of base 104 so that before, or concurrently with, accessing lifting tab 108 and opening container 100, frangible section 138 is severed, effectively signaling that container 100 has been tampered with.

With continued reference to FIGS. 1 and 3, if tear strip 150 is removed prior to bending corner portion 118 downward and gaining access to lifting tab 108, or if container 100 has been reclosed after already being opened, it is contemplated that the child-resistance of container 100 is still intact. Peripheral flange 106 that remains after removing tear strip 150 is small, e.g. a micro-flange, and is in overlapping abutment with an upper peripheral rim 110 of base 104, described in more detail below, such that access to container 100 through peripheral flange 106 is resisted. This means that to gain access to container 100, a consumer will still have to bend corner portion 118 downwardly to gain access to lifting tab 108, and then raise lifting tab 108 to remove the lid 102 from the base 104.

As shown in FIG. 3, container 100 is in the open position prior to being filled and closed for sale to consumers. Base 104 includes an upper peripheral rim 110. In this embodiment, upper peripheral rim 110 is extended upwardly to include an upwardly extending bead 111. Bead 111 extends substantially about the perimeter of container 100. Those skilled in the art will readily appreciate that, in the embodiment shown, a skirt 112 extends downwardly from bead 111 to a lower edge 113 thereof. It is contemplated that in embodiments without bead 111 on upper peripheral rim 110, skirt 112 depends downwardly directly from upper peripheral rim 110. In the closed position, peripheral flange 106 is in overlapping abutment with upper peripheral rim 110 and laterally abuts bead 111, rendering flange 106 relatively inaccessible, compelling the consumer to access container 100 at corner portion 118.

Figure 12:
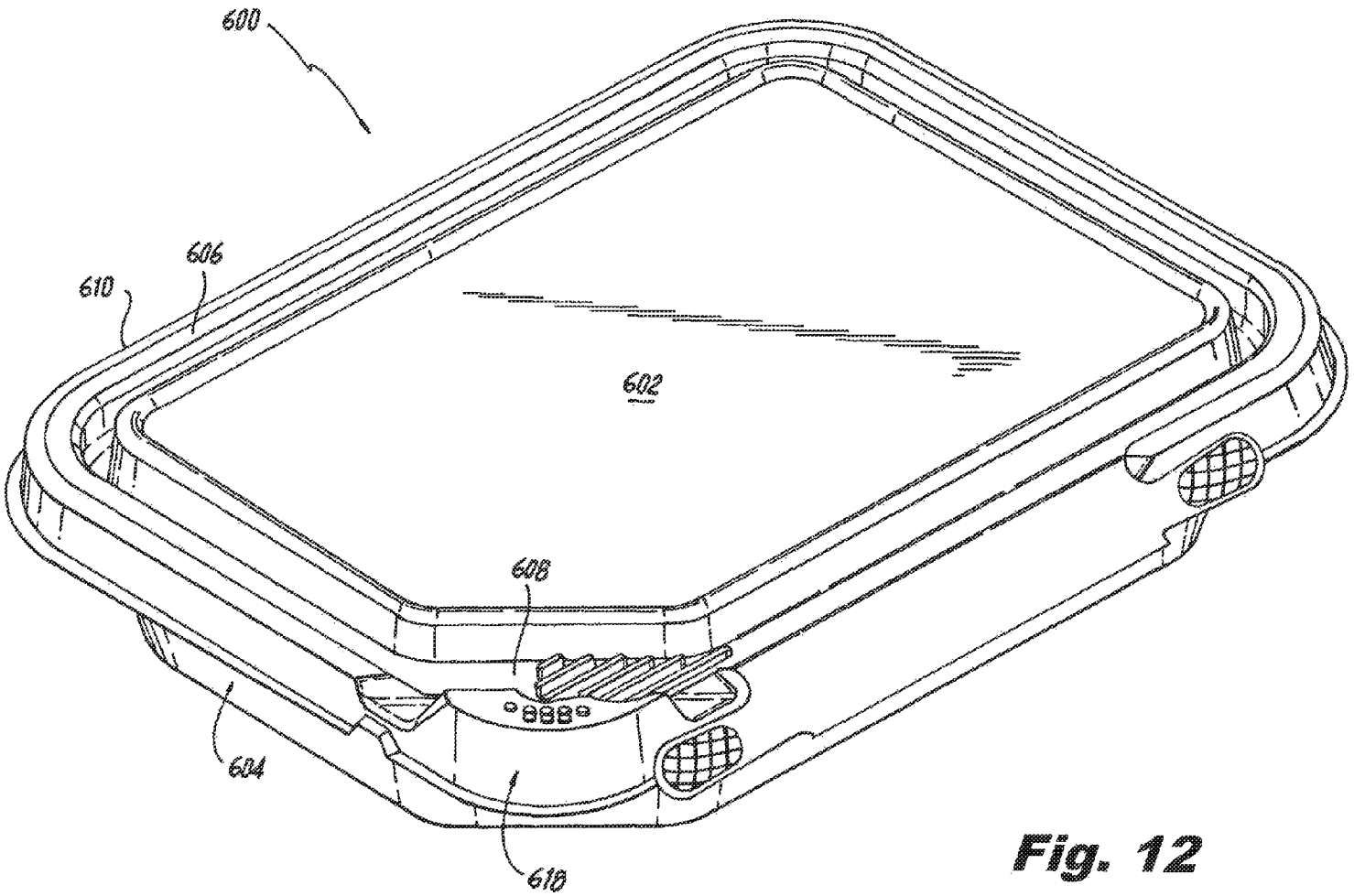
FIG. 12 is a perspective view of another embodiment of a child-resistant, tamper-resistant and tamper-evident container constructed in accordance with the present invention, showing overlapping abutment between the upper peripheral rim of the base and the peripheral flange of the cover.

With reference now to FIG. 12, another embodiment of a child-resistant container 600 is shown. Container 600 includes a lid 602 and a base 604. Container 600 is similar to container 100 in that lid 602 includes a peripheral flange 606 that defines a lifting tab 608. Container 600, however, does not include a bead, e.g. bead 111. The overlapping abutment between peripheral flange 606 and upper peripheral rim 610, is sufficient to hinder access to the peripheral flange 606. It is contemplated that peripheral flange 606 is small enough that, even if physical access to peripheral flange 606 is not blocked or rendered inaccessible by a bead, e.g. bead 111, the overlapping abutment between peripheral flange 606 as it extends outwardly from lid 602 and upper peripheral rim 610 is sufficient to hinder access to flange 606.

Alternatively, even without an overlapping abutment between flange 106 and upper peripheral rim 110, the lateral abutment between flange 106 and upper peripheral rim 110, as flange 106 extends upwardly from lid 102 is sufficient to hinder access to flange 106. Moreover, even if a consumer can lift flange 106, the lifting force required to remove lid 102 from base 104 cannot easily be transmitted through flange 106 because of its small size.

Figure 4:
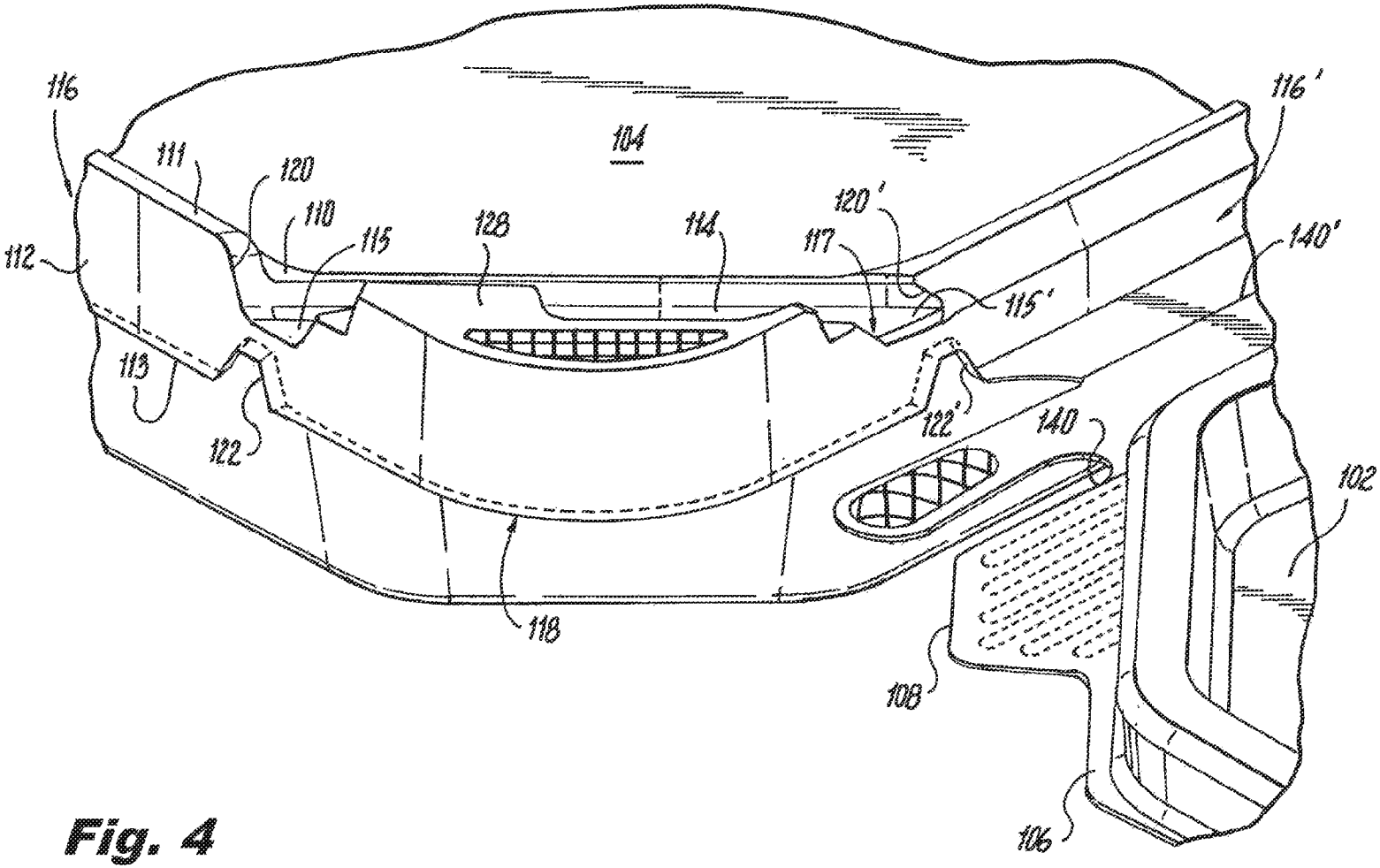
FIG. 4 is a perspective view of a portion of the container of FIG. 1, showing the container in an open position and the corner portion of the base having opposed indented portions and relief sections.

With reference now to FIG. 4, base 104 includes opposed indented portions 120 and 120' in skirt 112. A pair of relief sections 122 and 122', e.g. a pair of notches, is defined in lower edge 113 of the skirt 112. Each notch 122 and 122' is adjacent to a respective one of opposed indented portions 120 and 120'. Each notch 122 and 122' corresponds to a respective end 115 and 115' of bend line 117. Each notch 122 and 122' is defined on a respective side of the two adjacent sides 116 and 116' of base 104. Each notch 122 and 122' extends upwardly toward bend line 117 and groove 114. Each of the opposed indented portions 120 and 120' is adjacent to one of the ends 115 and 115' of bend line 117 and also define the ends of groove 114. Notches 122 and 122' provide clearance and reduced resistance for corner portion 118 during bending, tending to increase the ease of bending corner portion 118. Indented portions 120 and 120' similarly reduce the resistance to the bending of corner portion 118. Additionally, indented portions 120 and 120' and notches 122 and 122' assist in helping corner portion 118 return to its original, un-bent state after bending so that container 100 can readily be reused and remain child-resistant. While container 100 is shown and described herein as having notches 122 and 122', those skilled in the art will readily appreciate that they are not required for corner portion 118 to bend.

Figure 5:
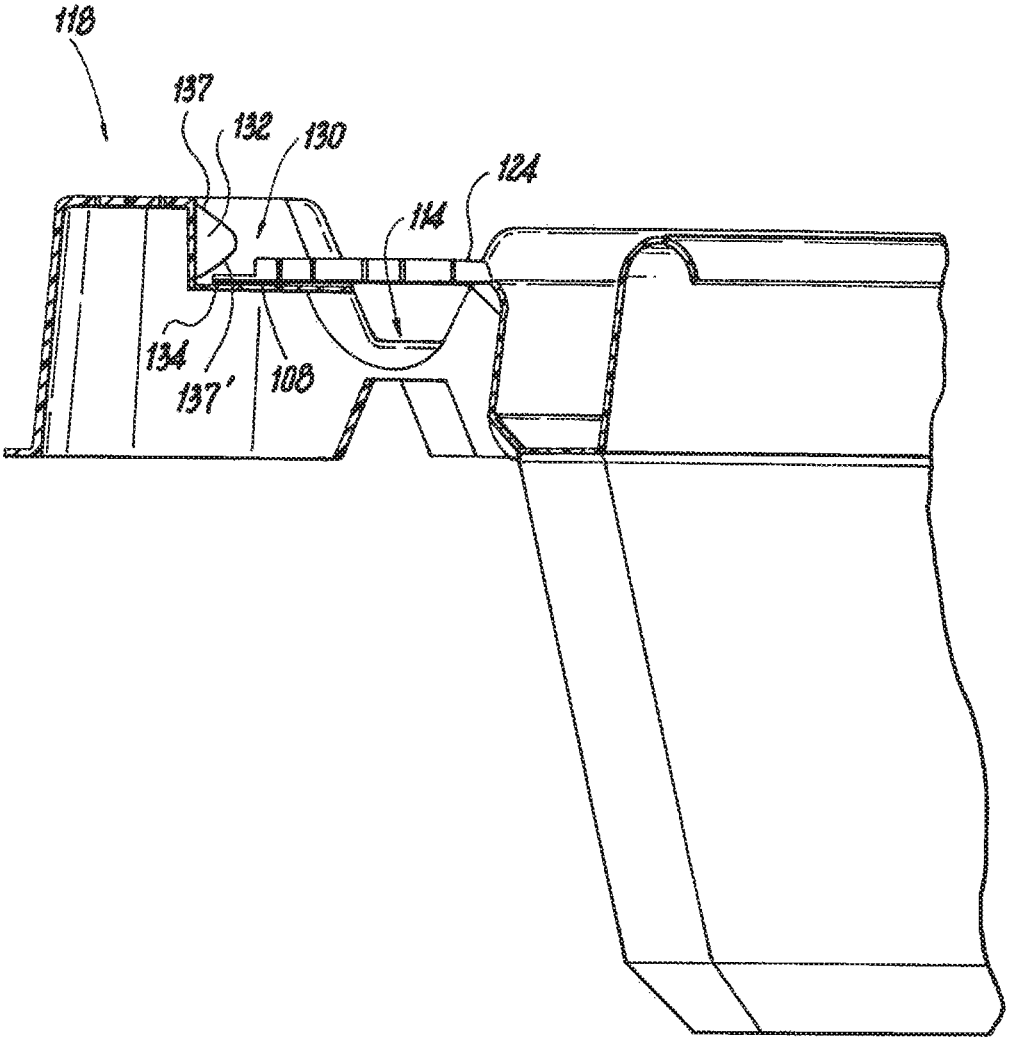
FIG. 5 is a cross sectional view of a portion of the container shown in FIG. 1, taken along line 5-5 of FIG. 1, showing the retaining portion keeping the lifting tab within the recess when the container is closed.

With reference now to FIG. 5, base 104 includes a recess 130 defined in corner portion 118 of base 104 adjacent to plateau 128 to receive lifting tab 108 when container 100 is closed. Base 104 includes a retaining projection 132 extending into recess 130 overlapping an outer edge 134 of lifting tab 108 when container 100 is closed. Retaining projection 132 includes beveled surfaces 137 and 137'. Beveled surface 137 faces in a direction away from the recess 130, e.g. away from lifting tab 108 when container 100 is closed. Beveled surface 137' faces in a direction toward the recess 130, e.g. toward lifting tab 108 when container 100 is closed. Retaining projection 132 keeps lifting tab 108 seated within recess 130 when container 100 is closed. Bending of corner portion 118, described above, acts to release lifting tab 108 from retaining projection 132 so that lifting tab 108 can be accessed.

Figure 6:
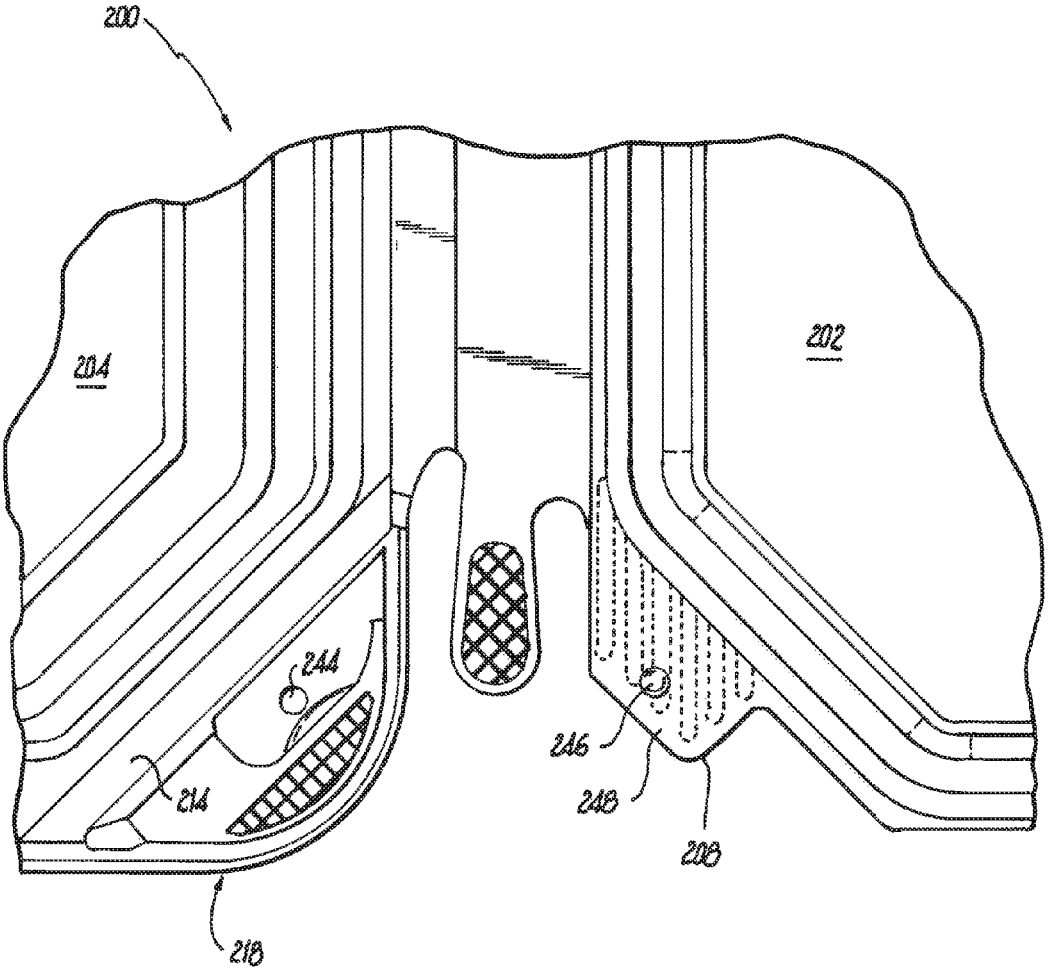
FIG. 6 is a top view of a portion of another embodiment of a child-resistant, tamper-resistant and tamper-evident container constructed in accordance with the present invention, showing the container having a lifting tab with a protrusion extending from a bottom surface thereof.

As shown in FIG. 6, another embodiment of a child-resistant container 200 is shown. Container 200 is similar to container 100. Container 200, however, includes a lid 202 having a lifting tab 208 with a top surface, not shown, and a bottom surface 248. Lifting tab 208 has a protrusion 246 extending from bottom surface 248. When container 200 is closed, protrusion 246 extends into an aperture 244 formed in corner portion 218 of the base 204. Protrusion 246 extends through aperture 244 and is accessible from the lower surface of corner portion 218 to provide additional lifting assistance for lifting tab 208. For example, instead of, or in addition to, bending corner portion 218 downward, a consumer can press protrusion 246 upward from the lower surface of corner portion 218 through aperture 244, thereby raising lifting tab 208.

Figure 7:
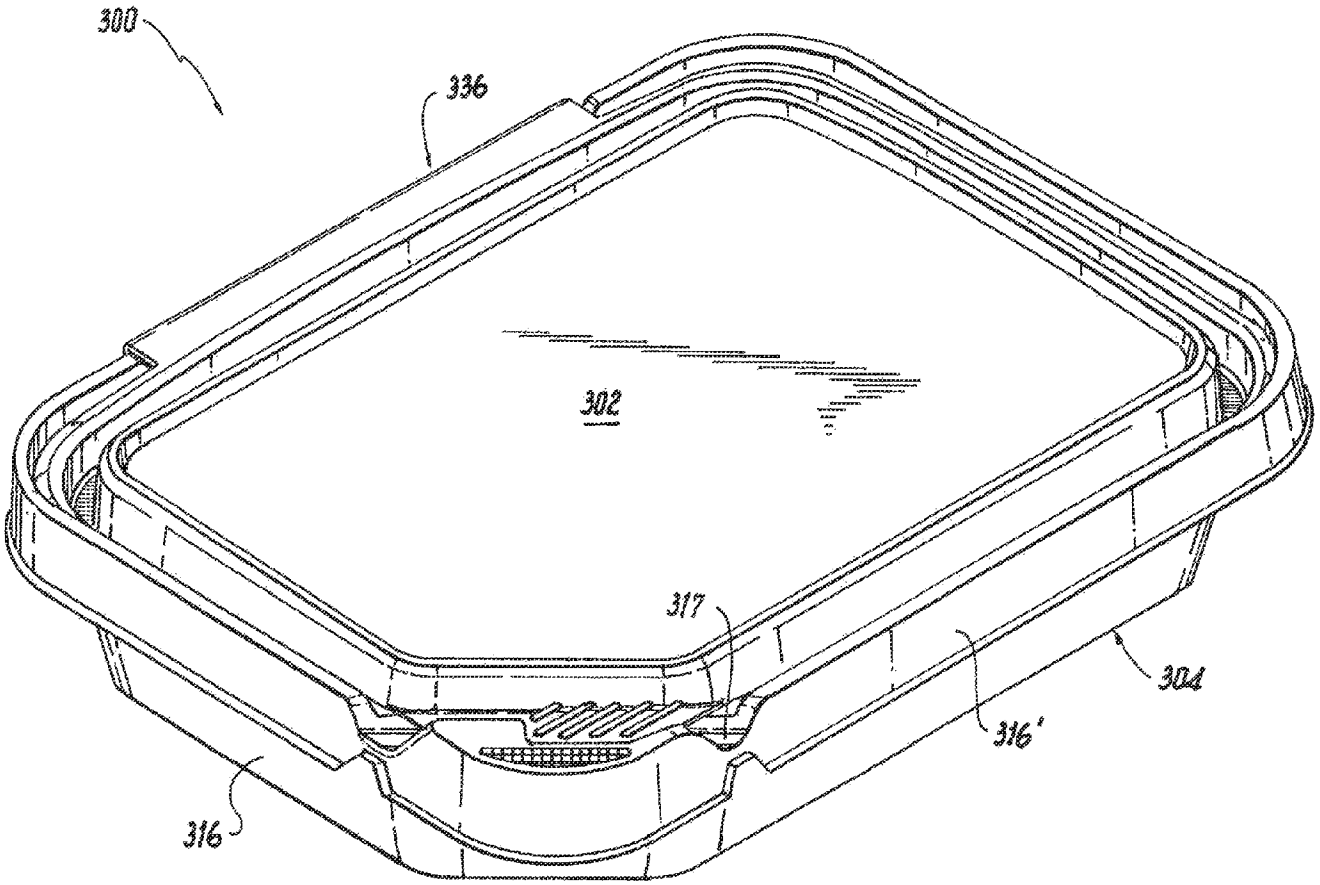
FIG. 7 is a perspective view of another embodiment of a child-resistant, tamper-resistant container constructed in accordance with the present invention, showing the container having a corner portion on the opposite lateral side from the hinge.

As shown in FIG. 7, another embodiment of a child-resistant container 300 is shown. Container 300 is similar to container 100. Container 300, however, includes a base 304 having a bend line 317 extending between two adjacent sides 316 and 316' and of base 304 to define a corner portion 318 that is opposite from hinge 336.

Figure 8:
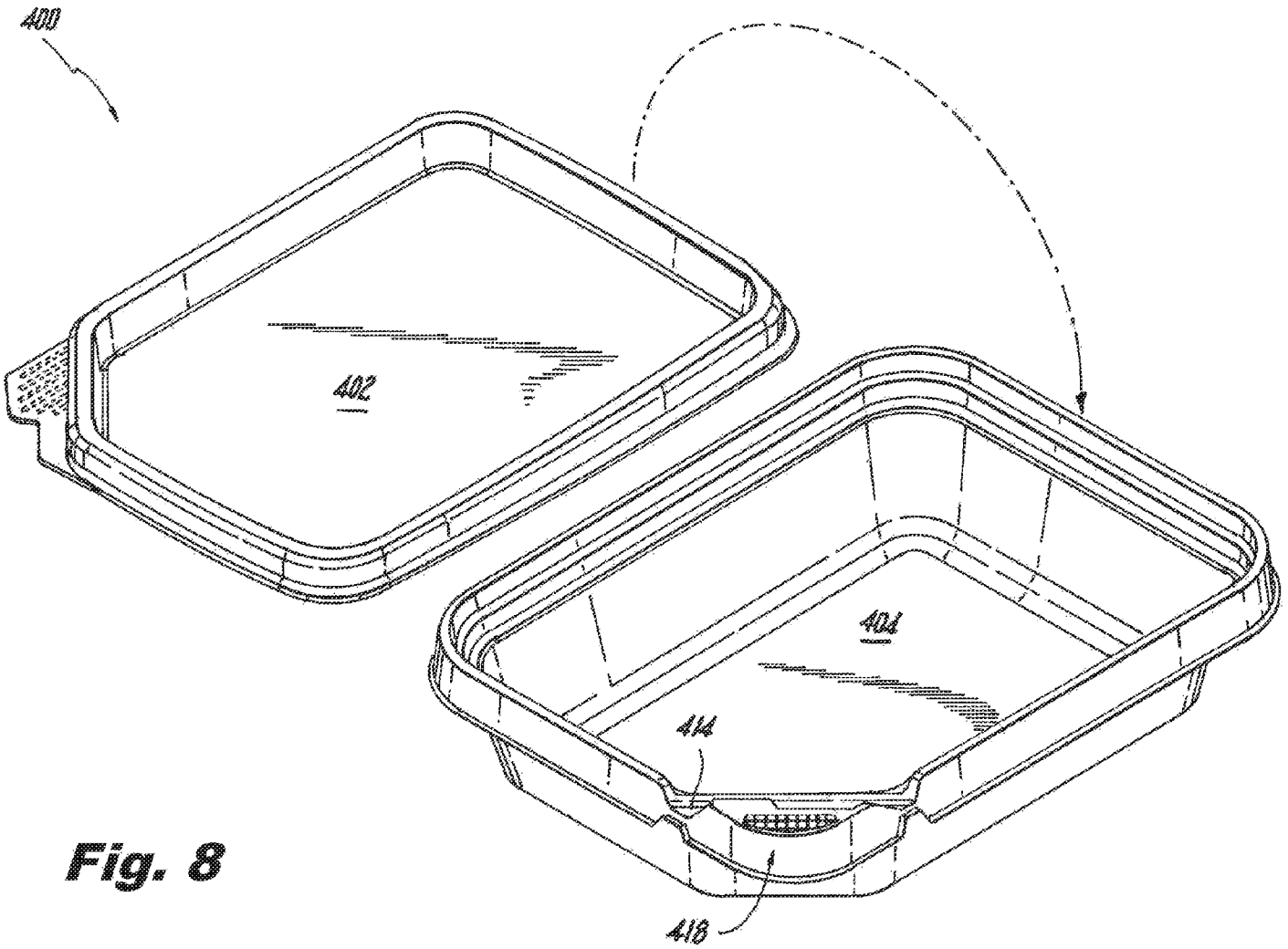
FIG. 8 is a perspective view of another embodiment of a child-resistant, tamper-resistant container constructed in accordance with the present invention, showing a two piece container without a hinge.

With reference now to FIG. 8, another embodiment of a child-resistant container 400 is shown. Container 400 is similar to container 100. Container 400, however, is a two piece container without a hinge, e.g. hinge 136 or 336.

As shown in FIGS. 9 and 10, another embodiment of a child-resistant container 500 is shown. Container 500 includes a lid 502 and a base 504. Container 500 is similar to container 200 in that lid 502 includes a peripheral flange 506 that defines a lifting tab 508. Base 504 includes an upper peripheral rim 510 and a bead 511 upwardly extending from upper peripheral rim 510. Peripheral flange 506 and lifting tab 508 are both rendered relatively inaccessible by bead 511. Those skilled in the art will readily appreciate that bead 511 is not necessary around the entirety of the perimeter and that the overlapping abutment between peripheral flange 506 and upper peripheral rim 510, as described above, is sufficient to hinder access to the peripheral flange 506 and to provide sufficient resistance to compel a consumer to use lifting tab 508 and a corner portion 518 to open container 500.

With reference now to FIGS. 10 and 11, base 504 includes a recess 530 defined in corner portion 518 of base 104. Base 504 includes a retaining projection 532 extending into recess 530 overlapping an outer edge 534 of lifting tab 508 when container 500 is closed, as shown in FIG. 9. Retaining projection 532 is similar to retaining projection 132, described above, and keeps lifting tab 508 seated within recess 530 when container 500 is closed. It is contemplated that container 500 can include a hinge, e.g. hinges 136 or 336.

With reference now to FIG. 11, lifting tab 508 is shown in a lifted position. Lifting tab includes a protrusion 546 extending from a bottom surface 548 thereof. Protrusion 546 extends into an aperture 544 formed in corner portion 518 of the base 504 when the container 500 is closed, as shown in FIG. 9. Protrusion 546 is accessible from the lower surface of corner portion 518 to provide lifting assistance for lifting tab 508, similar to protrusion 246 described above.

Those skilled in the art will readily appreciate that containers 100, 200, 300, 400 and 500 can be made from a variety of suitable materials such as, resins or plastic materials such as polyethylene, polypropylene, polyvinyl chloride or polyethylene terephthalate ("PETE"), as well as other suitable materials or combinations thereof, metallic materials, and/or paper materials. These materials can be transparent, translucent or opaque. It is also contemplated that the containers can be made in a variety of colors.

The methods and systems of the present disclosure, as described above and shown in the drawings, provide for containers with superior properties including child-resistance. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A child-resistant container comprising:

a lid having a peripheral flange which defines a lifting tab; and a base including:

an upper peripheral rim;

a skirt extending downwardly from the upper peripheral rim to a lower edge of the skirt;

a resilient bend line extending between two adjacent sides of the base to define a corner portion of the base that accommodates the lifting tab when the container is closed forming a child-resistant opening mechanism; and at least one of:

(i) a pair of relief sections defined in the lower edge of the skirt, wherein each relief section is proximate to a respective end of the bend line, or (ii) opposed indented portions in the skirt, wherein each of the opposed indented portions is adjacent to a respective end of the bend line.

2. The child-resistant container as recited in claim 1, wherein the bend line is defined by a groove extending between the two adjacent sides of the base.

3. The child-resistant container as recited in claim 1, wherein each relief section is defined on a respective side of the two adjacent sides of the base.

4. The child-resistant container as recited in claim 1, wherein each relief section is a notch extending upwardly toward the bend line.

5. The child-resistant container as recited in claim 1, wherein the lifting tab includes ribs extending upwardly from a top surface of the lifting tab.

6. The child-resistant container as recited in claim 1, wherein the upper peripheral rim includes a plateau on the corner portion of the base.

7. The child-resistant container as recited in claim 6, wherein the base includes a recess defined in the corner portion of the base adjacent to the plateau to receive the lifting tab when the container is closed.

8. The child-resistant container as recited in claim 7, wherein the base includes a retaining projection extending into the recess overlapping an outer edge of the lifting tab when the container is closed.

9. The child-resistant container as recited in claim 8, wherein the retaining projection includes a beveled surface facing in at least one of a direction toward the recess or a direction away from the recess.

10. The child-resistant container as recited in claim 1, wherein the lid includes a protrusion extending from a bottom surface of the lifting tab, wherein the protrusion extends into an aperture formed in the corner portion of the base when the container is closed.

11. The child-resistant container as recited in claim 1, further comprising a tamper-evident hinge joining the lid with the base, the hinge including a frangible section.

12. The child-resistant container as recited in claim 11, wherein the frangible section includes at least one line of weakness.

13. The child-resistant container as recited in claim 11, wherein the frangible section includes a single score line.

14. The child-resistant container as recited in claim 11, wherein the frangible section includes two parallel score lines defining a tear strip therebetween.

15. The child-resistant container as recited in claim 11, wherein the corner portion of the base and the tamper-evident hinge are on the same lateral side of the base.

16. The child-resistant container as recited in claim 1, wherein the base includes a bead extending upwardly from the upper peripheral rim and which extends substantially about the perimeter of the container.

17. The child-resistant container as recited in claim 16, wherein the skirt extends downwardly from the bead.

* * * * *